US008777772B2

(12) United States Patent
Hasegawa et al.

(10) Patent No.: US 8,777,772 B2
(45) Date of Patent: Jul. 15, 2014

(54) GOLF CLUB SHAFT AND GOLF CLUB USING THE SAME

(71) Applicant: Dunlop Sports Co. Ltd., Kobe (JP)

(72) Inventors: Hiroshi Hasegawa, Kobe (JP); Takashi Nakano, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 104 days.

(21) Appl. No.: 13/644,843

(22) Filed: Oct. 4, 2012

(65) Prior Publication Data

US 2013/0095949 A1 Apr. 18, 2013

(30) Foreign Application Priority Data

Oct. 12, 2011 (JP) ..... 2011-224798

(51) Int. Cl.
*A63B 53/10* (2006.01)

(52) U.S. Cl.
USPC ..... 473/318; 473/319; 428/36.3

(58) Field of Classification Search
CPC .. A63B 53/10; A63B 2209/023; A01K 87/00; B32B 19/02
USPC ..... 473/318, 319; 428/36.3
See application file for complete search history.

(56) References Cited

U.S. PATENT DOCUMENTS

| | | | | |
|---|---|---|---|---|
| 5,721,030 | A * | 2/1998 | Okada | 428/36.3 |
| 5,968,621 | A * | 10/1999 | Okada | 428/36.3 |
| 2008/0200280 | A1* | 8/2008 | Hasegawa | 473/319 |
| 2011/0224330 | A1* | 9/2011 | Sodano et al. | 523/442 |

FOREIGN PATENT DOCUMENTS

JP 2004-201911 A 7/2004

* cited by examiner

*Primary Examiner* — Michael Dennis
(74) *Attorney, Agent, or Firm* — Birch, Stewart, Kolasch & Birch, LLP

(57) ABSTRACT

A golf club shaft extending from a tip end to a butt end and made of fiber reinforced resin, comprises a weight being in a range of from 30 to 55 g, a whole length LS between the tip end and the butt end, a center of gravity of the shaft located with a distance LG from the tip end, a ratio of the distance LG to the whole length LS being in a range of from 0.54 to 0.65, a tip end portion which has a length of 300 mm from the tip end toward the butt end, the tip end portion including fibers including a pitch based carbon fiber and a PAN based carbon fiber, and said fibers in the tip end portion comprising, in weight, the pitch based carbon fiber of from 15 to 25% and the PAN based carbon fiber of from 85 to 75%.

10 Claims, 5 Drawing Sheets

GOLF CLUB SHAFT AND GOLF CLUB USING THE SAME

BACKGROUND OF THE INVENTION

1. Field of the Invention

The present invention relates to a golf club shaft and a golf club using the same to improve flight distance of hit ball.

2. Description of the Related Art

In recent years, to hold fair golf competitions, significant progress of flight distance of hit ball is restrained on the golf rule by controlling spring effect of a golf club head, a length of a golf club or moment of inertia of a golf club head. In such a circumstance, to improve flight distance of hit ball, JP2004-201911A1 proposed a golf club with a shaft as long as possible in a range of the rule, for example. Such golf club provides golfers with high head speeds using the longest club shaft.

However, such golf club with a long shaft tends to hit a ball at the outside the sweet spot of the club face due to the difficulty of control of the club head. Namely, smash-factor which is a ratio of a hit ball velocity to a club head velocity may decrease. Accordingly, it was difficult to improve flight distance of hit ball using the conventional golf club.

To solve the problem above, a golf club which has a club head with a weight greater than conventional club head and a club shaft with a short length is proposed. Such golf club makes the smash-factor improve, and a released ball velocity from the club face of the golf club can be faster. However, since the golf club tends to have a large moment of inertia, it is difficult to swing the golf club, and thereby the swing feeling tends to deteriorated.

It is an object of the present invention to provide a golf club shaft and a golf club using the same to improve flight distance of hit ball while keeping a better feeling of a golf swing.

SUMMARY OF THE INVENTION

In accordance with the present invention, there is provided a golf club shaft extending from a tip end to a butt end and made of fiber reinforced resin, comprising a weight being in a range of from 30 to 55 g, a whole length LS between the tip end and the butt end, a center of gravity of the shaft located with a distance LG from the tip end, a ratio of the distance LG to the whole length LS being in a range of from 0.54 to 0.65, a tip end portion which has a length of 300 mm from the tip end toward the butt end, the tip end portion including fibers including a pitch based carbon fiber and a PAN based carbon fiber, and said fibers in the tip end portion comprising, in weight, the pitch based carbon fiber of from 15 to 25% and the PAN based carbon fiber of from 85 to 75%.

DETAILED DESCRIPTION

An embodiment of the present invention will be explained below with reference to the accompanying drawings.

Figure 1:
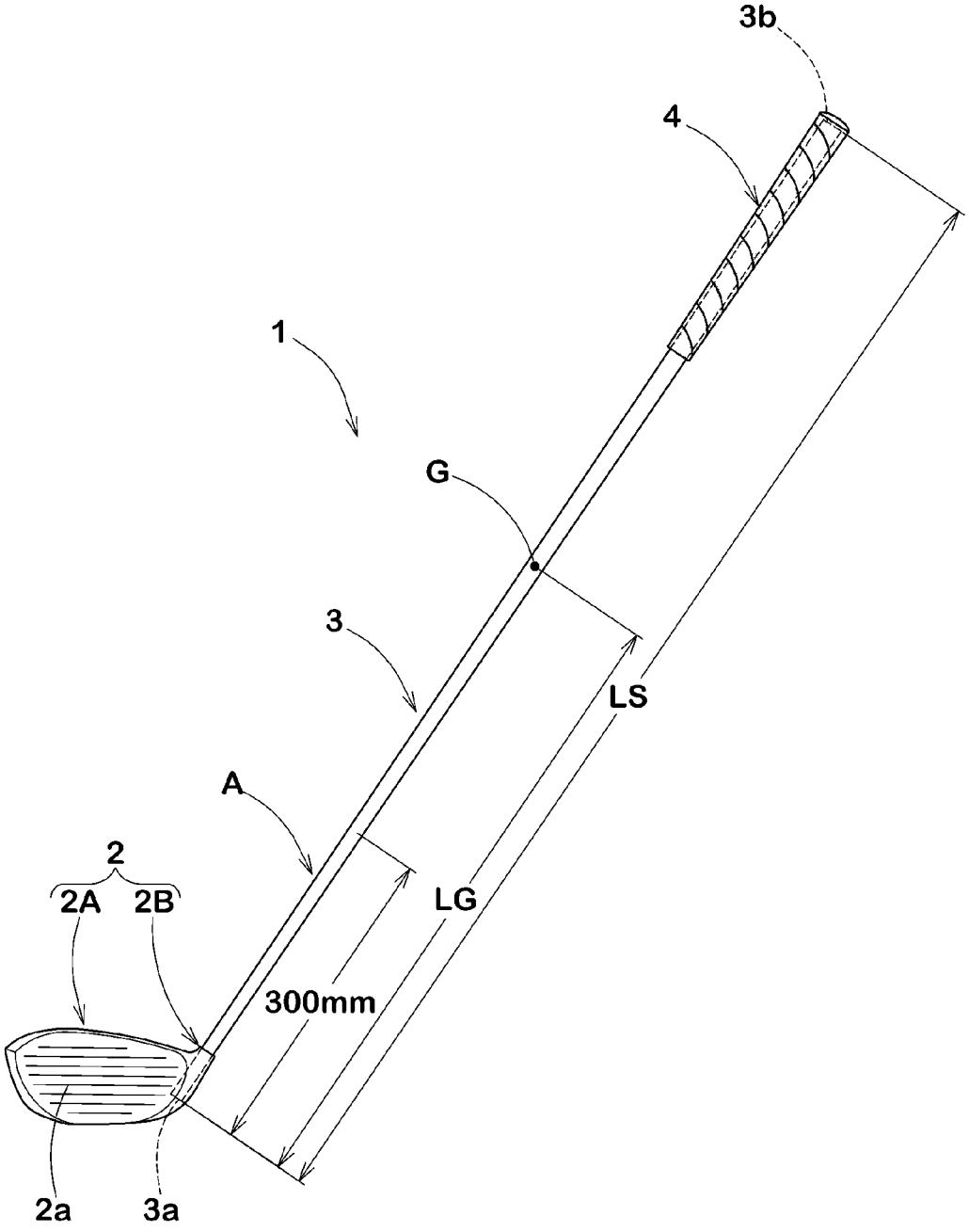
FIG. 1 is a front view of a golf club showing an embodiment of the present invention.

FIG. 1 shows a front view of a golf club 1 according to an embodiment of the present invention. The golf club 1 comprises a golf club head 2, a golf club shaft (hereinafter referred simply as "shaft") 3 and a grip 4.

It is not particularly limited, the golf club head 2 has a preferably weight not more than 290 g, more preferably not more than 287 g, further preferably not more than 284 g, preferably not less than 270 g, and more preferably not less than 273 g. If the weight of the club head 2 is too large, the club head speed may not be improved due to the difficulty of a golf swing. On the other hand, if the weight of the club head 2 is too small, the durability of the club head tends to deteriorated due to decrease of strength of the club head.

Although the club length of the golf club 1 is not particularly limited, the length is preferably set not less than 44.0 inches, more preferably not less than 44.5 inches and further preferably not less than 45.0 inches, and preferably set not more than 47.0 inches, more preferably not more than 46.5 inches, and further preferably not more than 46.0 inches. A golf club with such a club length provides golfers with a good swing balance and a high swing speed based on the length.

Here, the club length is measured based on the golf rule of "Option c. Length" of "Appendix II—Design of clubs" issued by the Royal and Ancient Golf Club of Saint Andrews (R&A).

The golf club head 2 is, for example, a wood-type golf club head which comprises: a hollowed main body 2A with a clubface 2*a* for hitting a ball; and a hosel portion 2B formed as a tubular body on a heel side of the main body 2A to which a tip end 3*a* of the club shaft 3 to be inserted. As for the club head 2, not only the wood-type club head, but also iron-type and utility-type club heads can be employed.

The club head 2 is produced from one or more kinds of metallic materials. Preferable examples of the metallic materials are, for instance, pure titanium, titanium alloy, stainless steel, maraging steel, soft iron and combinations of these metals. Further, although not shown in the drawings, non-metallic materials with a lower specific gravity such as fiber reinforced resin may be used in a part of the club head 2. To shift a center of gravity of the club head toward the bottom side, for example, the club head 2 preferably has an upper portion made of a CFRP member at least partially, and a bottom portion made of a titanium alloy at least partially.

The club head 2 preferably has a weight not less than 185 g, more preferably not less than 192 g, not more than 210 g, preferably not more than 206 g, and further preferably not more than 203 g. Such a golf club head 2 with the weight provides golfers with a good swing balance and can transmit a large kinetic energy to a hit ball.

In a suitable embodiment, a ratio of the club head weight to the golf club weight (club head weight/golf club weigh) is set not less than 0.670, more preferably not less than 0.675, and more preferably not less than 0.680, and is preferably set not more than 0.720 and more preferably not more than 0.715. Such golf club 1 with the ratio provides golfers with a good swing balance and can transmit a large kinetic energy to a hit ball.

The grip 4 is made of a rubber compound which includes, for example, a natural rubber, oil, a carbon black, sulfur and an oxide of zinc. The rubber compound is kneaded, and vulcanized to form the predetermined grip shape. The weight of the grip 4 is preferably set in the range of from 27 to 45 g, in order to maintain the strength, the durability and easy golf swing.

The club shaft 3 has the tip end 3*a* to be attached to the hosel portion 2B of the club head 2, and a butt end 3*b* attached to the grip 4. Namely, the tip end 3*a* of the club shaft 3 is located in interior of the club head 2, and the butt end 3*b* is located inside the grip 4. As shown in FIG. 1, reference symbol "G" shows a center of gravity of the club shaft 2. The center of gravity G of the club shaft 3 is located on the shaft center line. Moreover, the club shaft 3 in this embodiment includes a tapered tubular body with a circular section and extends from the butt end 3*b* toward the tip end 3*a* while decreasing the outer diameter.

The club shaft 3 in this embodiment is made of fiber reinforced resin including reinforcing fibers and a matrix resin to fix the reinforcing fibers dipped therein. Such club shaft 3 made of fiber reinforced resin has a light weight as compared to a steel shaft, and a design flexibility to adjust the flexural rigidity thereof. The club shaft 3 is manufactured by a sheet winding method using a prepreg which is a sheet body of reinforcing fibers impregnated with a heat-hardening resin, for example. Therefore, the club shaft 3 has the tubular body including a plurality of plies of reinforcing fibers. As shown in FIG. 1, the club shaft 3 has a whole length LS between the tip end 3*a* and the butt end 3*b*, and a distance LG from the tip end 3*a* to the center of gravity G of the club shaft 3.

The club shaft 3 has a weight Ws in a range of from 30 g to 55 g. If the weight Ws of the club shaft 3 is too small, strength of the club shaft 3 tends to be deteriorated due to decreasing the thickness of the shaft 3 to keep a certain necessary length. From this point of view, the weight Ws of the club shaft 3 is set at least 30 g, more preferably not less than 32 g, and more preferably not less than 34 g. on the other hand, if the weight Ws of the club shaft 3 is greater than 55 g, the swing speeds of the golf club 1 using such shaft 3 may be decreased. From this point of view, the weight Ws of the club shaft 3 is set at most 55 g, preferably not more than 54 g, and more preferably not more than 53 g.

The club shaft 3 has a ratio LG/LS of the distance LG to the whole length LS being in a range of from 0.54 to 0.65. Namely, the club shaft 3 according to the present invention has the center of gravity G of the shaft 3 shifted toward the butt end 3*b*. Such golf club shaft 3 and the golf club 1 using the same can obtain the suitable moment of inertia of the golf club providing golfers with easy operation due to the specified weight and the specified weight balance. Accordingly, golfers who use the club shaft 3 according to the present invention can easily perform a golf swing that they want. Moreover, the smash factor may be improved and thereby flight distance of hit ball may be increased, when the whole length LS is set as a short length.

If the ratio LG/LS is less than 0.54, the center of gravity G of the club shaft 3 may be close to the tip end 3*a*, and thereby a club head in light weight may be required to maintain the swing balance of the golf club well for such golf club shaft. Usually, the club head with a light weight has an undesirable small moment of inertia, and decreases the smash factor. From this point of view, the ratio LG/LS is preferably set not less than 0.55, and more preferably not less than 0.56.

on the other hand, if the ratio LG/LS is greater than 0.65, the center of gravity G of the club shaft 3 may be significantly close to the butt end 3*b*, and thereby a heavy club head may be required to maintain the swing balance of the golf club well for such golf club shaft, and such club shaft tends to have undesirable decreased strength on the side of the tip end 3*a*. From this point of view, the ratio LG/LS is preferably set not more than 0.64, and more preferably not more than 0.63.

The whole length LS of the club shaft 3 is not particularly limited. However, if the whole length LS is too small, a radius of swing of the golf club may be small, and thereby it is difficult to improve the swing speed of golf club. On the other hand, if the whole length LS is too large, the moment of inertia of the golf club 1 tends to be large, and thereby it may be difficult to perform a golf swing. From this point of view, the whole length LS of the club shaft 3 is preferably set not less than 105 cm, more preferably not less than 107 cm, and further preferably not less than 110 cm. Moreover, the whole length LS of the club shaft 3 is preferably set not more than 120 cm, more preferably not more than 118 cm, and further preferably not more than 116 cm.

In order to shift the position of the center of gravity G of the club shaft, the thickness and/or the taper angle of the club shaft in the axial direction may be changed, for example. These adjustments can be done by changing the winding times of prepreg sheets (see below), for example.

The club shaft 3 has a tip end portion (A) which has a length of 300 mm from the tip end 3*a* toward the butt end 3*b*. The tip end portion (A) includes reinforcing fibers including a pitch based carbon fiber and a PAN based carbon fiber. Moreover, reinforcing fibers of the tip end portion (A) comprise, in weight, the pitch based carbon fiber of from 15 to 25% and the PAN based carbon fiber of from 85 to 75%.

The tip end portion (A) which includes the PAN based carbon fiber with a high flexural strength can prevent deterioration of the flexural rigidity thereof. On the other hand, if the content of PAN based carbon fiber is too high, impact strength of the shaft 3 tends to significantly deteriorate, and thereby the durability of the shaft 3 is decreased. To solve the problem above, the pitch based carbon fiber with high impact absorption performance is required in the tip end portion (A), and thereby the flexural rigidity of the tip end portion (A) is maintained while preventing the deterioration of the impact strength of the shaft 3. Moreover, by employing the pitch based carbon fiber into the tip end portion (A), ball-hitting feeling can be improved due to the high impact absorption performance thereof.

Here, the PAN based carbon fiber is included from 85 to 75% in weight of whole fibers of the tip end portion (A). If the content of the PAN based carbon fiber in the tip end portion (A) is less than 75% in weight, the durability of the shaft 3 tends to deteriorate due to the decreasing flexural strength of the tip end portion (A). On the other hand, if the content of the PAN based carbon fiber is more than 85% in weight, the ball-hitting feeling and impact strength of the shaft 3 tends to significantly deteriorate. In the light of these, the content in weight of the PAN based carbon fiber of the whole fibers in the tip end portion (A) is preferably not less than 76%, more preferably not less than 77%, preferably not more than 84%, and more preferably not more than 83%.

The pitch based carbon fiber is included from 15 to 25% in weight of whole fibers of the tip end portion (A). If the content of the pitch based carbon fiber in the tip end portion (A) is less than 15% in weight, the ball-hitting feeling and impact strength of the shaft 3 tends to significantly deteriorate. On the other hand, if the content of the pitch based carbon fiber is more than 25% in weight, the durability of the shaft 3 tends to deteriorate due to the decreasing flexural strength of the tip end portion (A). In the light of these, the content in weight of the pitch based carbon fiber of the whole fibers in the tip end portion (A) is preferably not less than 16%, more preferably not less than 17%, preferably not more than 24%, and more preferably not more than 23%. Moreover, the elastic modulus of the pitch based carbon fiber is preferably set not more than 10 t/mm$^2$.

In the preferably aspect of the present invention, the PAN based carbon fiber included in the tip end portion (A) comprises a straight fiber which is parallel with an axial direction of the shaft 3, and the straight fiber is contained, in weight, not less than 50%, more preferably not less than 51%, and further preferably not less than 52% of whole fibers in the tip end portion (A). The straight fiber effectively improves the flexural strength of the tip end portion (A). On the other hand, if the content in weight of the straight fiber is too high, the torsional stiffness in the tip end portion (A) tends to decrease. Accordingly, the content in weight of the straight fiber in the tip end portion (A) is preferably not more than 80%, more preferably not more than 79%, further preferably not more than 78% of the whole fibers in the tip end portion (A). Moreover, the elastic modulus of the straight fiber is preferably set in a range of from 24 to 30 t/mm$^2$.

In the preferably aspect of the present invention, the PAN based carbon fiber included in the tip end portion (A) comprises a bias fiber which is inclined at an angle of 45 degrees plus/minus 5 degrees with respect to the axial direction of the shaft, and the bias fiber is contained in a range of from 5% to 25% in weight of whole fibers in the tip end portion (A). The bias fiber improves both of the torsional stiffness and strength of the tip end portion (A) in a well-balanced manner. If the content in weight of the bias fiber is less than 5% of whole fibers in the tip end portion (A), it is difficult to improve the torsional stiffness of the tip end portion (A). In the light of this, the content in weight of the bias fiber is preferably not less than 6%, and more preferably not less than 7% of whole fibers in the tip end portion (A). On the other hand, if the content in weight of the bias fiber is too high, the flexural rigidity of the tip end portion (A) tends to decrease. In the light of this, the content in weight of the bias fiber is preferably not more than 25%, more preferably not more than 24%, and more preferably not more than 23%. Moreover, the elastic modulus of the bias fiber is preferably set in a range of from 40 to 60 t/mm$^2$.

In the present invention, other specifics than the tip end portion (A) of the shaft 3 are not particularly limited. Therefore, the other specifics of the shaft 3 may be designed according to the custom. As one aspect of the preferable embodiment, the shaft 3 has a flexural rigidity EI at a position P1 of 100 mm length from the tip end 3*a* of the shaft 3 being not more than 2.0 kgf m$^2$.

Figure 2:
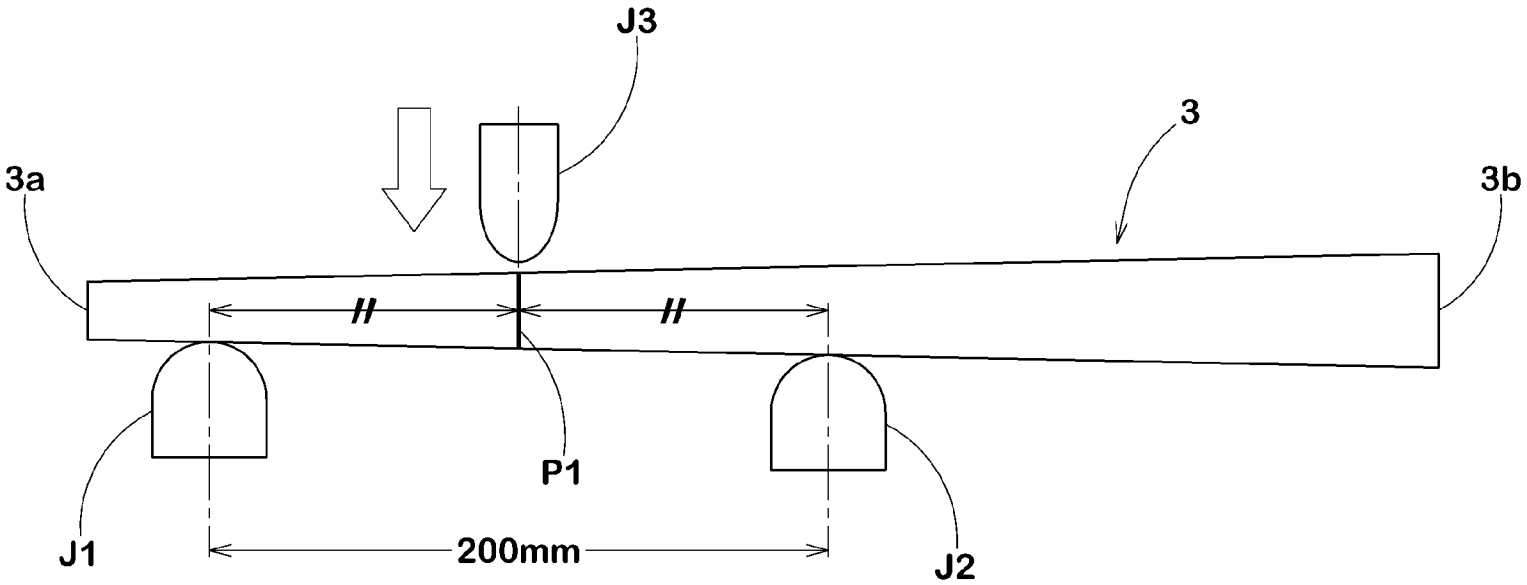
FIG. 2 is a side view explaining of a method for measurement of a flexural rigidity of a golf club shaft.

As shown in FIG. 2, the flexural rigidity EI of the shaft 3 is measured using an all-purpose material machine (model-2020 produced by INTESCO co., ltd.). In the measuring method, the shaft 3 is horizontally supported by using two supporting jigs J1 and J2 which have the span of 200 mm. In this state, supporting jigs J1 and J2 are adjusted so that the position P1 of the shaft 3 is located with the center C of the span. Next, a load of F is applied downward to the position P1 at which the flexural rigidity value EI is measured. The More specifically, when the load F reached 20 kgf at a load-applying speed of 5 mm/min, the movement of a load-applying part J3 is finished. At that time, the flexibility amount of the shaft 3 is measured. The cross-sectional shape of the supporting jigs J1 and J2 have tips with curvature radiuses of 12.5 mm in the cross section, and the load-applying part J3 has a tip with a curvature radius of 5 mm in the cross section. The flexural rigidity EI is computed by using an equation shown below.

Flexural Rigidity $EI$=(Maximum load $F$×(span between supporting jigs)$^3$)/(48×flexibility amount)

The position P1 at which the flexural rigidity EI is measured is located near the club head 2. Accordingly, when the flexural rigidity at the position P1 of the shaft 3 is greater than 2.0 kgf m$^2$, the golf club with such a shaft having the high flexural rigidity may not be sufficiently flexed during the golf swing, and thereby the hit ball may not go up higher and the flight distance of hit ball tends to decrease. Accordingly, the flexural rigidity EI at the position P1 is preferably not more than 1.9 kgf m$^2$, and more preferably not more than 1.9 kgf m$^2$. On the other hand, when the flexural rigidity at the position P1 of the shaft 3 is too small, the golf club with such a shaft having the low flexural rigidity may flex too much during the golf swing, and thereby hit balls may widely be dispersed in undesirable directions and the flight distance of hit ball tends to decrease. Accordingly, the flexural rigidity EI at the position P1 is preferably not less than 0.8 kgf m$^2$, more preferably not less than 0.9 kgf m$^2$, and further preferably not less than 1.0 kgf m$^2$.

The club shaft 3 is preferably produced by so-called a sheet winding method using a prepreg sheet. In this embodiment, as for the prepreg sheet, an UD-prepreg sheet with fibers each oriented substantially in one direction may be employed in the method. The term "UD" stands for uni-direction. However, prepreg sheets other than the UD prepreg may be used. For example, a cloth-prepreg with woven fibers may be used.

The prepreg sheet has a fiber such as carbon fiber and a matrix resin such as a thermosetting resin including an epoxy resin, for example. In a state of the prepreg, the matrix resin is in a non cured state including a semicured state. The shaft 3 is produced by winding prepreg sheets around a mandrel with a diameter equal to the inner diameter of the club shaft 3 and curing them. This curing is attained by heating.

As for the prepreg sheet, various products commercially available may be used. Table 1 shows some products of prepreg sheets.

TABLE 1

| | | | | | Fiber Spec. | | |
|---|---|---|---|---|---|---|---|
| Manufacturers | Prepreg sheet Number | Thickness (mm) | Fiber content (mass %) | Resin content (mass %) | Fiber Kinds | Elastic modulus* (t/mm$^2$) | Tensile strength* (kgf/mm$^2$) |
| Toray Industries, Inc. | 3255S-10 | 0.082 | 76 | 24 | T700S | 23.5 | 500 |
| Toray Industries, Inc. | 3255S-12 | 0.103 | 76 | 24 | T700S | 23.5 | 500 |
| Toray Industries, Inc. | 3255S-15 | 0.123 | 76 | 24 | T700S | 23.5 | 500 |
| Toray Industries, Inc. | 805S-3 | 0.034 | 60 | 40 | M30S | 30 | 560 |
| Toray Industries, Inc. | 2255S-10 | 0.082 | 76 | 24 | T800S | 30 | 600 |
| Toray Industries, Inc. | 2255S-12 | 0.102 | 76 | 24 | T800S | 30 | 600 |
| Toray Industries, Inc. | 2255S-15 | 0.123 | 76 | 24 | T800S | 30 | 600 |
| Toray Industries, Inc. | 2256S-10 | 0.077 | 80 | 20 | T800S | 30 | 600 |
| Toray Industries, Inc. | 2256S-12 | 0.103 | 80 | 20 | T800S | 30 | 600 |

TABLE 1-continued

| Manufacturers | Prepreg sheet Number | Thickness (mm) | Fiber content (mass %) | Resin content (mass %) | Fiber Spec. Fiber Kinds | Elastic modulus* ($t/mm^2$) | Tensile strength* ($kgf/mm^2$) |
|---|---|---|---|---|---|---|---|
| Nippon Graphite Fiber Cop. | E1026A-09N | 0.100 | 63 | 37 | XN-10 | 10 | 190 |
| Mitsubishi Rayon Co. Ltd. | TR350C-100S | 0.083 | 75 | 25 | TR50S | 24 | 500 |
| Mitsubishi Rayon Co. Ltd. | TR350C-125S | 0.104 | 75 | 25 | TR50S | 24 | 500 |
| Mitsubishi Rayon Co. Ltd. | TR350C-150S | 0.124 | 75 | 25 | TR50S | 24 | 500 |
| Mitsubishi Rayon Co. Ltd. | MR350C-075S | 0.063 | 75 | 25 | MR40 | 30 | 450 |
| Mitsubishi Rayon Co. Ltd. | MR350C-100S | 0.085 | 75 | 25 | MR40 | 30 | 450 |
| Mitsubishi Rayon Co. Ltd. | MR350C-125S | 0.105 | 75 | 25 | MR40 | 30 | 450 |
| Mitsubishi Rayon Co. Ltd. | MR350E-100S | 0.093 | 70 | 30 | MR40 | 30 | 450 |
| Mitsubishi Rayon Co. Ltd. | HRX350C-075S | 0.057 | 75 | 25 | HR40 | 40 | 450 |
| Mitsubishi Rayon Co. Ltd. | HRX350C-110S | 0.082 | 75 | 25 | HR40 | 40 | 450 |

*Values of the tensile strength and the elastic modulus are measured based on "Testing methods for carbon fibers" specified on JIS R7601: 1986.

Figure 3:
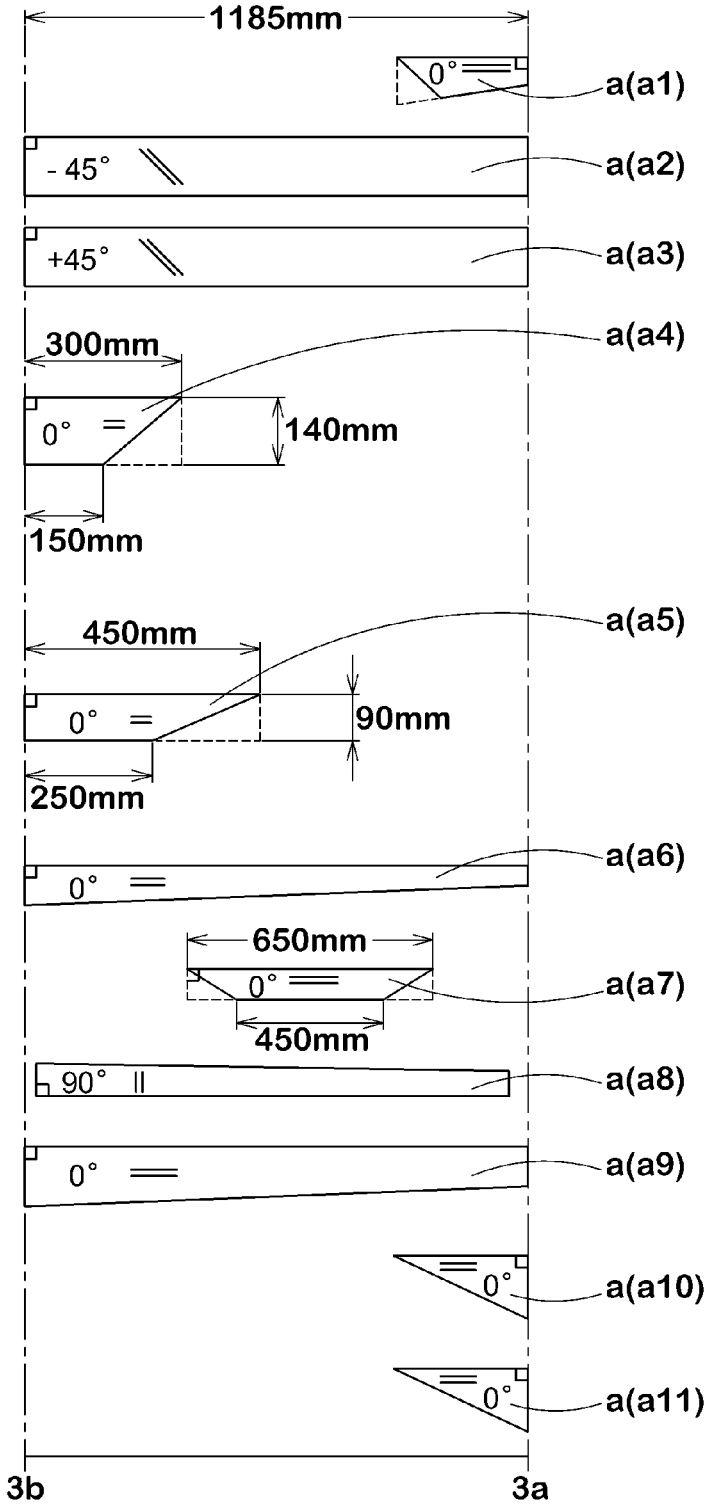
FIG. 3 is a development view of prepreg sheets included in a golf club shaft.

FIG. 3 shows a development view (sheet constitution view) of prepreg sheets which compose of the club shaft 3 according to one embodiment of the present invention. The club shaft 3 comprises a plurality of prepreg sheets (a). In the present application, the development view as shown in FIG. 3 shows the sheets constituting the shaft in order from the radially inner side of the shaft. The prepreg sheets are wound around the mandrel in order from the sheets located above in the development view. In the development view of FIG. 3, the horizontal direction of the figure corresponds with the axial direction of the club shaft, wherein the right side of the figure corresponds to the tip end 3*a* side, and the left side of the figure corresponds to the butt end 3*b* side of the club shaft, respectively. Also, each prepreg sheet (a) is shown at where the prepreg sheet is wound in the axial direction of the shaft 3.

Prepreg sheets (a) according to one embodiment of the present invention comprise a straight sheet, a bias sheet and a hoop sheet.

The straight sheet has a reinforcing fiber oriented at an angle of substantially 0 degree with respect to the axial direction of the club shaft. Here, "substantially 0 degree" of the fiber means that the fiber has an oriented angle of within plus/minus 10 degrees with respect to the axial direction of the club shaft, and preferably has the oriented angle of within plus/minus 5 degrees with respect to the axial direction of the club shaft. After curing the straight prepreg, the oriented angle of reinforcing fiber in the straight sheet is maintained in the range of the angle above. In this embodiment, each sheet a1, a4, a5, a6, a7, a9, a10 and a11 is formed as the straight sheet. These straight sheets are highly correlated with the flexural rigidity and strength of the shaft, and therefore, a main portion of the club shaft 3 is composed of straight sheets.

The bias sheet has a reinforcing fiber oriented at a certain angle with respect to the axial direction of the club shaft. Therefore, the bias fiber described above is comprised of the reinforcing fiber in the bias sheet after curing. In this embodiment, each sheet a2 and a3 is formed as the bias sheet. The bias sheet a2 has a reinforcing fiber oriented at angle of minus 45 degrees, and the bias sheet a3 has a reinforcing fiber oriented at angle of plus 45 degrees with respect to the axial direction of the shaft. Namely the bias sheets a2 and a3 have reinforcing fibers oriented at the same angles with in the opposite direction to each other. Such pair of bias sheets are preferably provided in order to enhance the torsional rigidity and strength of the club shaft due to fibers oriented in opposite directions. Also, a pair of bias sheets can reduce anisotropy of strength of the club shaft.

The hoop sheet has a reinforcing fiber oriented at an angle of substantially 90 degrees with respect to the axial direction of the club shaft. The sheet a8 is the hoop sheet. Here, "substantially 90 degrees" of the fiber means that the fiber has an oriented angle of 90 degrees plus/minus 10 degrees with respect to the axial direction of the club shaft.

The hoop sheet is provided in order to enhance the crushing rigidity and strength of the club shaft 3. The crushing rigidity and strength are rigidity and strength against a force crushing the club shaft toward the inner side in the radial direction thereof. The crushing strength can be interlocked with flexural deformation to generate crushing deformation. In a particularly thin lightweight shaft, this interlocking property is large. The enhancement of the crushing strength also causes the enhancement of the bending strength.

Each prepreg sheet is sandwiched between cover sheets before use in winding. The cover sheets comprise a release paper stuck on one surface of the prepreg sheet and a resin film stuck on the other surface of the prepreg sheet. The release paper has a flexural rigidity greater than that of the resin film. Hereinafter, the surface on which the release paper is stuck is referred to as "a surface of a release paper side", and the surface on which the resin film is stuck is referred to as "a surface of a film side". Also, in the development view of FIG. 3, the surface of the film side is the front side. Namely, in the development view of FIG. 3, the front side of the figure is the surface of the film side of the prepreg sheet, and the back side of the figure is the surface of the release paper side of the prepreg sheet.

In the state of FIG. 3, the fibrous oriented direction of the sheet a2 is the same as that of the sheet a3. However, in the state of the laminating thereof to be described later, the sheet a3 is reversed, and thereby the fibrous directions of the sheets a2 and a3 are opposite to each other. In light of this point, in FIG. 3, the fibrous direction of the sheet a2 is described as "−45 degrees", and the fibrous direction of the sheet a3 is described as "+45 degrees".

In order to wind the prepreg sheet (a) around the mandrel, the resin film being stuck thereon is removed from the prepreg sheet (a). By removing the resin film, the surface of the film side which has stickiness due to uncured matrix resin is exposed. Next, the sticky edge portion in the surface of the film side of the prepregs sheet (a) is attached onto the mandrel, and then, the prepregs sheet (a) is wound around the mandrel by rotating the mandrel while removing the release paper from the prepregs sheet (a).

In the winding step of prepregs sheets above, since the release paper supports prepreg sheets and improves its bending resistance, creases on prepreg sheets during winding can be prevented. Accordingly, by winding prepregs sheets based on the step above, failures such as creases occurred in the edge of prepregs sheets may be prevented, and thereby the quality of the club shaft can be improved.

Figure 4:
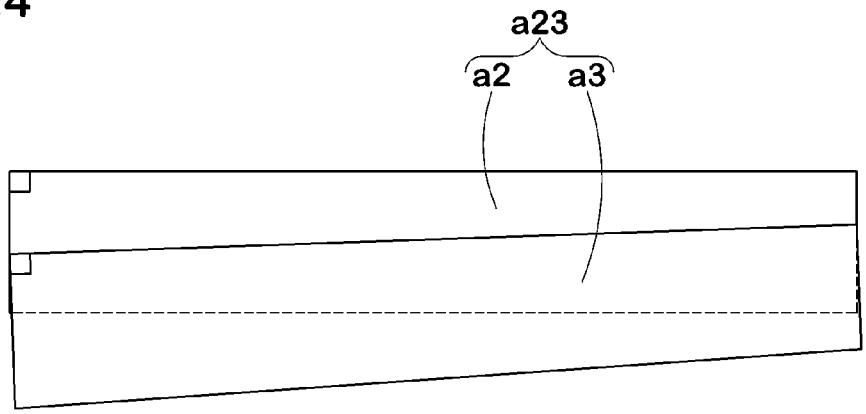
FIG. 4 is a plan view of a first laminated prepreg sheets.
Figure 5:
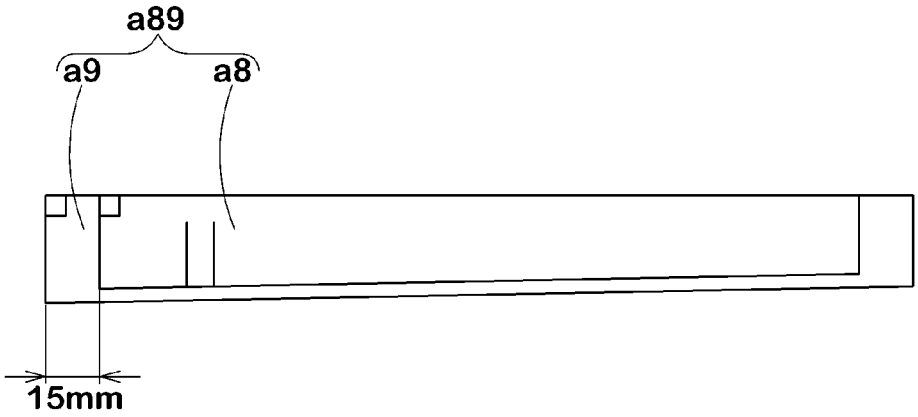
FIG. 5 is a plan view of a second laminated prepreg sheets.

A combination prepreg sheets which is piled at least two prepreg sheets before winding on the mandrel may be preferably employed. In this embodiment, two types of combination prepreg sheets are employed as shown in FIGS. 4 and 5. FIG. 4 shows the first combination sheet a23 which combines two bias sheets a2 and a3 each other. FIG. 5 shows the second combination sheet a89 which combines the hoop sheet a8 and the straight sheet a9 each other.

The first combination sheet a23 shown in FIG. 4 is produced using the steps of: reversing the bias sheet a3; and attaching the reversed bias sheet a3 onto the bias sheet a2. In this embodiment, as shown in FIG. 4, the edge of the butt end side of the bias sheet a3 is located a distance of 24 mm from the upper edge of the bias sheet a2, and the edge of the tip end side of the bias sheet a3 is located a distance of 10 mm from the upper edge of the bias sheet a2. Namely, each upper edge of bias sheets a2 and a3 are not parallel with each other.

In the first combination sheet a23, a circumferentially difference between the bias sheets a2 and a3 corresponds to a circumference angle of about 180 degrees plus/minus 15 degrees with respect to the club shaft cured. Such first combination sheet a23 is useful to disperse ends of reinforcing fibers in each prepreg sheet, and thereby the uniformity of the shaft along the circumferential direction is improved.

As shown in FIG. 5, the upper edges of hoop sheet a8 and straight sheet a9 are consistent with each other in the second combination sheet a89. Also, both the edges of tip end side and butt end side of the hoop sheet a8 are located inside from the straight sheet a9. In this embodiment, the difference between edges of the hoop and straight sheets a8 and a9 in each side is about 15 mm, as shown in FIG. 5. Accordingly, the hoop sheet a8 is fully supported on the straight sheet a9. Basically, winding the hoop sheet a8 which has reinforcing fibers laid at high angles with respect to the axial direction onto the mandrel is difficult. However, such combination sheet a89 in which the hoop sheet a8 is fully supported on the straight sheet a9 is easy to wind onto the mandrel, and thereby failures in winding hoop sheets a8 are prevented.

Next, the producing method of the shaft 3 using prepreg sheets (a) shown in FIG. 3 is described. The method according to the present embodiment includes the processes of: (1) Cutting process; (2) Laminating Process; (3) Winding Process; (4) Tape Wrapping Process; (5) Curing Process; (6) Process of Extracting Mandrel and Process of Removing wrapping Tape; (7) Process of Cutting Both Ends; (8) Polishing Process; and (9) Coating Process.

(1) Cutting Process:

Each prepreg sheet a1 to a11 is prepared by cutting the original sheet body into a desired shape in the cutting process, as shown in FIG. 3.

(2) Laminating Process:

Combination sheets a23 and a89 are prepared by combining a plurality of prepreg sheets together in the laminating process. To combine a plurality of prepreg sheets into one, heating and/or pressing processes may be employed. Suitable parameters such as the temperature in the heating process and/or the pressure in the pressing process may be selected in order to improve the adhesive strength of prepreg sheets.

(3) Winding Process:

The mandrel which is typically made of metallic material is employed in this process. The mandrel has an outer surface which is previously coated with parting agent and a resin (tacking resin) disposed outside the parting agent. The prepreg sheets (a) are wound around the mandrel respectively in the winding process. The tacking resin is useful for fixing the winding start edge of the prepreg sheet on the mandrel due to its stickiness. Each of the first and second combination sheets a23 and a89 is also wound as the combined state. After the winding process, a winding body which includes a plurality of wound prepreg sheets on the mandrel is obtained.

(4) Tape Wrapping Process:

A tape is wrapped around the outer peripheral surface of the winding body in the tape wrapping process. This tape is also referred to as a wrapping tape. This wrapping tape is wrapped with a tension to apply pressure to the winding body in order to discharge included air therein, and can prevent that a void is generated in the cured club shaft.

(5) Curing Process:

In the curing process, the winding body after performing the tape wrapping is heated. This heating cures the matrix resin to form a cured resin laminated body. In this curing process, the matrix resin fluidizes temporarily. This fluidization of the matrix resin can discharge air between prepreg sheets or in the sheet. The pressure applied from the wrapping tape accelerates this discharge of the air.

(6) Process of Extracting Mandrel and Process of Removing Wrapping Tape:

The process of extracting the mandrel and the process of removing the wrapping tape are performed after curing process. The order of the both processes is not limited. However, the process of removing the wrapping tape is preferably performed after the process of extracting the mandrel in light of enhancing the efficiency of the process of removing the wrapping tape.

(7) Process of Cutting Both Ends:

The both end parts of the cured laminate body are cut in this process. This cutting forms the tip end 3*a* and the butt end 3*b* of the shaft. This cutting flattens the end face of the tip end 3*a* and the end face of the butt end 3*b*.

(8) Polishing Process:

The surface of the cured laminate body is polished in this process. This polishing is also referred to as surface polishing. Spiral unevenness left behind as the trace of the wrapping tape may exist on the surface of the cured laminate body. The polishing extinguishes the unevenness as the trace of the wrapping tape to flatten the surface of the cured laminate body.

(9) Coating Process

The cured laminate body after the polishing process is subjected to coating.

The club shaft 3 is produced through the processes from 1 to 9 described above. The tip end 3*a* of the club shaft 3 is inserted and attached to the hosel portion 2B of the club head 2, and the grip 4 is attached onto the butt end 3*b* of the club shaft 3 to obtain the golf club 1.

Comparison Test

Golf clubs with club shafts based on Tables 2 to 6 are made and tested. All golf clubs have the same club heads made of titanium alloy with a volume of 460 $cm^3$.

All club shafts have the same lengths of 115 cm, and made in accordance with prepreg sheets with elastic modulus and shapes shown in FIG. 3 and Table 1. The pitch based carbon fibers are employed carbon fibers with elastic modulus of 10 $t/mm^2$. As for the PAN based carbon fibers, straight fibers are employed carbon fibers with elastic modulus of 24 and 30 $t/mm^2$, bias fibers are employed carbon fibers with elastic modulus of 40 $t/mm^2$, and hoop fibers are employed carbon fibers with elastic modulus of 30 $t/mm^2$, respectively.

The manufacturing method of each club shaft was as above-mentioned processes of 1 to 9. In each prepreg sheet a1 to a11, the winding number of prepreg sheets, the thickness of prepreg sheets, the ratio of content of fibers in prepreg sheets, and elastic modulus of carbon fibers were suitably adjusted. The thickness of club shafts was modified in order to adjust the center of gravity of the club shaft. The test methods were as follows.

Total Distance of Hit Ball:

The average total distance of five shots by a golfer with an average head velocity of 42 m/s was measured in each tested golf club. The larger the value is, the performance the better is.

Figure 6:
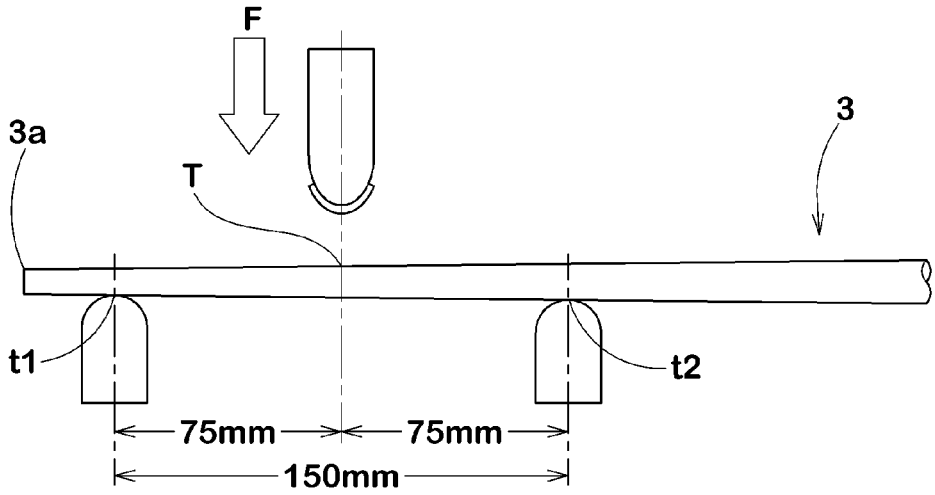
FIG. 6 is a side view explaining a method for measurement of "T-point strength" of a golf club shaft.

The Strength of Tip End Side of Club Shaft:

The strength of tip end side of club shaft (the strength of the T-point) is measured based on the shaft three-point flexural strength of SG mark method. The three-point flexural strength of the club shaft corresponds to the fracture strength of the shaft in SG type defined by the Consumer Product Safety Association. FIG. 6 is an explanation view showing the measurement of the three-point flexural strength of the club shaft in SG mark method. In the method, the downward force F is applied at the position T of the club shaft 3 which is being supported at the positions t1 and t2. The position T is located with the center between the positions t1 and t2. The position T is set as the position at where the strength should be measured. In this embodiment, the position T is located with the distance of 90 mm from the tip end of the club shaft. In such a case, the span between the position t1 and t2 is set of 150 mm, and thereby the position t1 is located with the distance of 15 mm from the tip end of the club shaft 3. Then, the peak force F when the club shaft 3 has been broken is measurement. The larger the value, the performance the better is.

Figure 7:
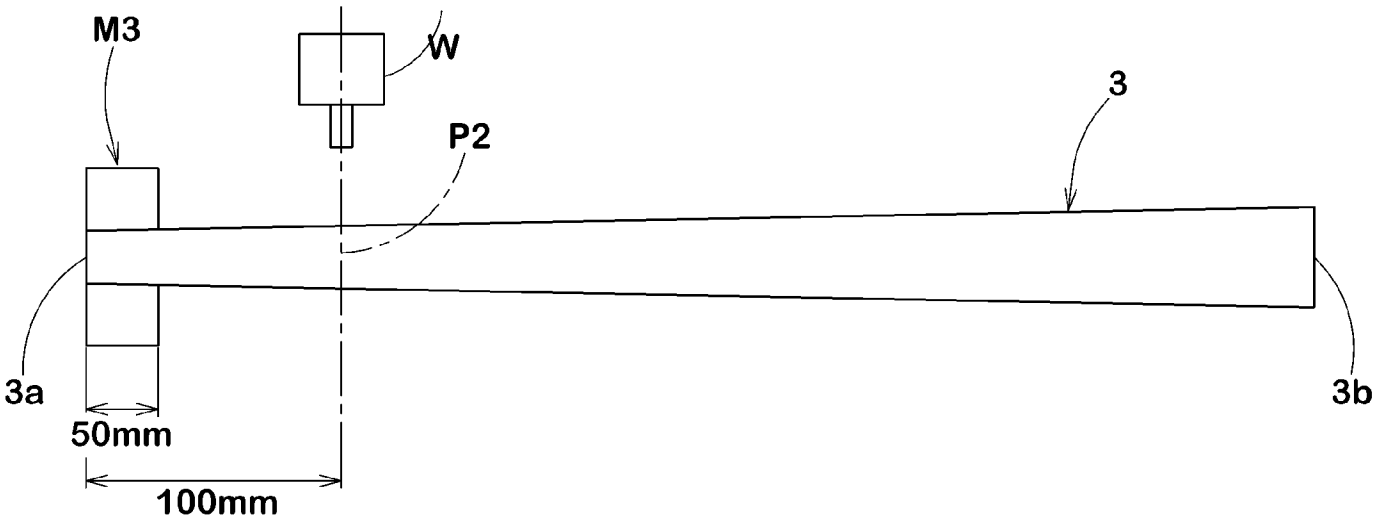
FIG. 7 is a side view explaining of a method for measurement of shock energy of a golf club shaft.

Shock Energy Test:

As shown in FIG. 7, in order to measure the shock energy of the shaft 3, the tip end 3*a* thereof is supported using a supporting jig M3 with a width of 50 mm, and a shock was generated by dropping a weight W with 1012 g from a height of 1500 mm so that the weight collided with the position P2 of the shaft 3 which is located with the distance of 100 mm from the tip end 3*a*. Then, the shock energy of the shaft 3 is computed as an integral value (J) from the recorded relation between the load and the flexure of the shaft 3 in a range of from the time of collision between the weight and the shaft 3 until the peak of the load.

Figure 8:
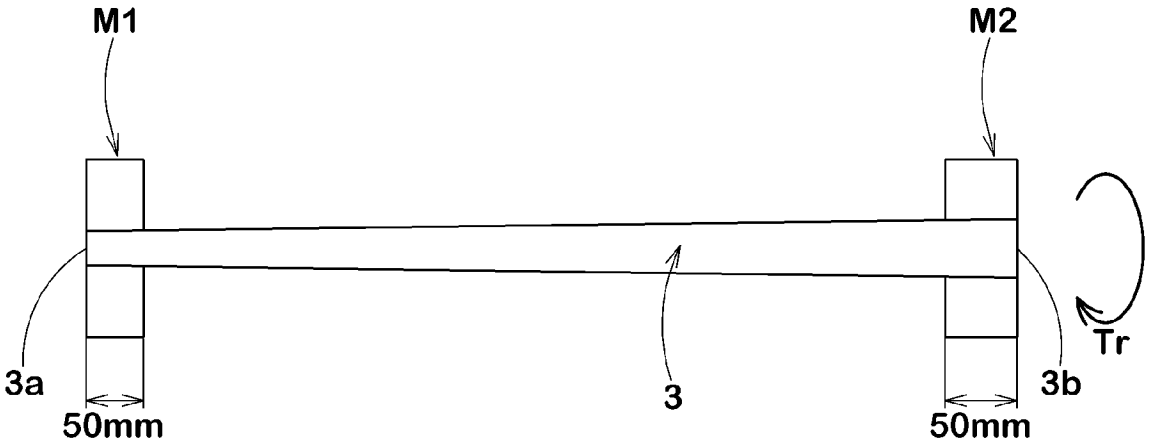
FIG. 8 is a side view explaining of a method for measurement of torsional stiffness of a golf club shaft.

Torsional Strength:

As shown in FIG. 8, in order to measure the torsional strength of the shaft, the tip end 3*a* and the butt end 3*b* thereof are supported using the first jig M1 and the second jig M2 each with a width of 50 mm, respectively. The first jig M1 is fixed so that the tip end 3*a* cannot rotate, and the second jig M2 is given a torque Tr (N m) to generate a torsional angle to the club shaft 3. Moreover, the torsional strength (N m deg) of the shaft is computed by multiplying the torque Tr (N m) and the torsional angle θ (deg.) of the shaft 3.

The results are shown in Tables 2 to 5.

TABLE 2

| | Ref. 1 | Ex. 1 | Ex. 2 | Ex. 3 | Ex. 4 | Ref. 2 |
|---|---|---|---|---|---|---|
| Ratio LG/LS | 0.52 | 0.54 | 0.56 | 0.63 | 0.65 | 0.66 |
| Content of pitch based carbon fibers in tip end portion (weight %) | 21 | 21 | 21 | 21 | 21 | 21 |
| Content of PAN based carbon fibers in tip end portion (weight %) | 79 | 79 | 79 | 79 | 79 | 79 |
| Content of straight fibers in PAN based carbon fibers (weight %) | 53 | 53 | 53 | 53 | 53 | 53 |
| Content of 45 deg. bias fibers in PAN based carbon fibers (weight %) | 23 | 23 | 23 | 23 | 23 | 23 |
| Content of 0 deg. hoop fibers in PAN based carbon fibers (weight %) | 3 | 3 | 3 | 3 | 3 | 3 |
| Shaft weight (g) | 52 | 52 | 52 | 52 | 52 | 52 |
| Flexural rigidity at 100 mm from tip end (kgf $m^2$) | 2 | 1.9 | 1.8 | 1.3 | 1.2 | 0.9 |
| Strength of tip end side (T-point strength) (kgf) | 210 | 205 | 200 | 190 | 185 | 175 |
| Shock energy (J) | 4.00 | 3.90 | 3.80 | 3.70 | 3.60 | 3.50 |
| Torsional strength (Nm deg) | 1500 | 1500 | 1500 | 1500 | 1500 | 1500 |
| Total distance of hit ball (yard) | 190 | 200 | 204 | 208 | 209 | 210 |

TABLE 3

| | Ref. 3 | Ex. 5 | Ex. 2 | Ex. 6 | Ex. 7 | Ref. 4 |
|---|---|---|---|---|---|---|
| Ratio LG/LS | 0.56 | 0.56 | 0.56 | 0.56 | 0.56 | 0.56 |
| Content of pitch based carbon fibers in tip end portion (weight %) | 14 | 15 | 21 | 23 | 25 | 26 |
| Content of PAN based carbon fibers in tip end portion (weight %) | 86 | 85 | 79 | 77 | 75 | 74 |
| Content of straight fibers in PAN based carbon fibers (weight %) | 60 | 59 | 53 | 51 | 49 | 48 |
| Content of 45 deg. bias fibers in PAN based carbon fibers (weight %) | 23 | 23 | 23 | 23 | 23 | 23 |
| Content of 0 deg. hoop fibers in PAN based carbon fibers (weight %) | 3 | 3 | 3 | 3 | 3 | 3 |
| Shaft weight (g) | 52 | 52 | 52 | 52 | 52 | 52 |
| Flexural rigidity at 100 mm from tip end (kgf $m^2$) | 2.00 | 1.90 | 1.80 | 1.10 | 0.90 | 0.80 |
| Strength of tip end side (T-point strength) (kgf) | 210 | 205 | 200 | 190 | 185 | 175 |
| Shock energy (J) | 3.40 | 3.60 | 3.80 | 3.90 | 3.95 | 4.00 |
| Torsional strength (Nm deg) | 1500 | 1500 | 1500 | 1500 | 1500 | 1500 |
| Total distance of hit ball (yard) | 200 | 202 | 204 | 208 | 209 | 210 |

TABLE 4

| | Ref. 5 | Ex. 8 | Ex. 2 | Ex. 9 | Ex. 10 | Ref. 6 |
|---|---|---|---|---|---|---|
| Ratio LG/LS | 0.56 | 0.56 | 0.56 | 0.56 | 0.56 | 0.56 |
| Content of pitch based carbon fibers in tip end portion (weight %) | 21 | 21 | 21 | 21 | 21 | 21 |
| Content of PAN based carbon fibers in tip end portion (weight %) | 79 | 79 | 79 | 79 | 79 | 79 |
| Content of straight fibers in PAN based carbon fibers (weight %) | 53 | 53 | 53 | 53 | 53 | 53 |
| Content of 45 deg. bias fibers in PAN based carbon fibers (weight %) | 23 | 23 | 23 | 23 | 23 | 23 |
| Content of 0 deg. hoop fibers in PAN based carbon fibers (weight %) | 3 | 3 | 3 | 3 | 3 | 3 |
| Shaft weight (g) | 29 | 30 | 52 | 53 | 55 | 56 |
| Flexural rigidity at 100 mm from tip end (kgf $m^2$) | 0.80 | 0.90 | 1.80 | 1.90 | 1.95 | 2.00 |
| Strength of tip end side (T-point strength) (kgf) | 175 | 182 | 200 | 205 | 210 | 215 |
| Shock energy (J) | 3.40 | 3.60 | 3.80 | 3.90 | 3.95 | 4.00 |
| Torsional strength (Nm deg) | 1500 | 1500 | 1500 | 1500 | 1500 | 1500 |
| Total distance of hit ball (yard) | 210 | 200 | 204 | 202 | 200 | 190 |

TABLE 5

| | Ex. 13 | Ex. 11 | Ex. 2 | Ex. 12 | Ex. 13 | Ref. 7 | Ex. 14 | Ex. 15 |
|---|---|---|---|---|---|---|---|---|
| Ratio LG/LS | 0.56 | 0.56 | 0.56 | 0.56 | 0.56 | 0.56 | 0.56 | 0.56 |
| Content of pitch based carbon fibers in tip end portion (weight %) | 21 | 21 | 21 | 15 | 15 | 14 | 15 | 21 |
| Content of PAN based carbon fibers in tip end portion (weight %) | 79 | 79 | 79 | 85 | 85 | 86 | 85 | 79 |
| Content of straight fibers in PAN based carbon fibers (weight %) | 49 | 50 | 53 | 78 | 80 | 81 | 81 | 46 |
| Content of 45 deg. bias fibers in PAN based carbon fibers (weight %) | 23 | 23 | 23 | 7 | 5 | 5 | 4 | 26 |
| Content of 0 deg. hoop fibers in PAN based carbon fibers (weight %) | 7 | 6 | 3 | 0 | 0 | 0 | 0 | 7 |
| Shaft weight (g) | 52 | 52 | 52 | 52 | 52 | 52 | 52 | 52 |
| Flexural rigidity at 100 mm from tip end (kgf $m^2$) | 1.20 | 1.50 | 1.80 | 1.95 | 2.00 | 2.10 | 2.00 | 1.20 |
| Strength of tip end side (T-point strength) (kgf) | 187 | 192 | 200 | 205 | 210 | 215 | 215 | 190 |
| Shock energy (J) | 3.80 | 3.80 | 3.80 | 3.60 | 3.60 | 3.50 | 3.60 | 3.80 |
| Torsional strength (Nm deg) | 1500 | 1500 | 1500 | 1005 | 1000 | 1000 | 1000 | 1700 |
| Total distance of hit ball (yard) | 210 | 200 | 204 | 202 | 200 | 190 | 192 | 210 |

From the test results, it was confirmed that the golf clubs of the Examples according to the present invention can be improved the feeling of golf swing, and strengths of tip end side and the butt end side of the club shaft while increasing the total distance of hit balls.

while, as shown in Table 2, the reference 1 cannot be improved the total distance of hit balls as the ratio of LG/LS thereof is small. On the other hand, the reference 2 cannot improve the strength of the tip end side of the club shaft, since the shaft has a large ratio of LG/LS by setting the tip end side thinner.

As shown in Table 3, the reference 3 cannot improve resistance of the shock energy due to the less content of pitch based carbon fibers. The reference 4 cannot be improved the strength of the tip end side of the club shaft due to the much content of pitch based carbon fibers therein.

As shown in Table 4, the reference 5 cannot be improved the strength of the tip end side of the shaft due to the less content of PAN based carbon fibers therein. The reference 6 cannot be improved the total distance of hit ball due to the large weight of the club shaft.

As shown in Table 5, the example 13 may decrease the strength of the tip end portion due to the less content of straight fibers in the PAN based carbon fibers therein. The reference 7 cannot be improved the flight distance of hit balls due to the much content of straight fibers in the PAN based carbon fibers.

As shown in Table 6, example 18 may decrease the torsional strength of the shaft due to the less content of bias fibers in the PAN based carbon fibers, and the example 19 may decrease the strength of tip end portion due to the much bias fibers in the PAN based carbon fibers.

The invention claimed is:

1. A golf club shaft extending from a tip end to a butt end and made of fiber reinforced resin, comprising a weight being in a range of from 30 to 55 g, a whole length LS between the tip end and the butt end, a center of gravity of the shaft located with a distance LG from the tip end, a ratio of the distance LG to the whole length LS being in a range of from 0.54 to 0.65, a tip end portion which has a length of 300 mm from the tip end toward the butt end, the tip end portion including fibers including a pitch based carbon fiber and a PAN based carbon fiber, and said fibers in the tip end portion comprising, in weight, the pitch based carbon fiber of from 15 to 25% and the PAN based carbon fiber of from 85 to 75%.

2. The golf club shaft according to claim 1, wherein said PAN based carbon fiber in the tip end portion comprises a straight fiber being parallel with an axial direction of the shaft, and the straight fiber is contained, in weight, in a range of from 50 to 80% of whole fibers in the tip end portion.

3. The golf club shaft according to claim 1 or 2, wherein said PAN based carbon fiber in the tip end portion comprises a bias fiber inclined at an angle of 45 degrees plus/minus 5 degrees with respect to an axial direction of the shaft, and said bias fibers in the tip end portion are contained, in weight, in a range of from 5% to 25% of whole fibers in the tip end portion.

4. The golf club shaft according to claim 1 or 2, wherein the shaft has a flexural rigidity EI at a position of 100 mm length from the tip end of the shaft is not more than 2.0 kgf $m^2$.

5. The golf club shaft according to claim 1 or 2, wherein the ratio of the distance LG to the whole length LS is in a range of from 0.55 to 0.64.

6. The golf club shaft according to claim 1 or 2, wherein the ratio of the distance LG to the whole length LS is in a range of from 0.56 to 0.63.

7. The golf club shaft according to claim 1 or 2, wherein said fibers in the tip end portion comprises, in weight, the pitch based carbon fiber of from 16 to 24% and the PAN based carbon fiber of from 84 to 76%.

8. The golf club shaft according to claim 1 or 2, wherein said fibers in the tip end portion comprises, in weight, the pitch based carbon fiber of from 17 to 23% and the PAN based carbon fiber of from 83 to 77%.

9. The golf club shaft according to claim 1 or 2, wherein the shaft has a flexural rigidity EI at a position of 100 mm length from the tip end of the shaft is in a range of from 0.9 to 1.8 kgf $m^2$.

10. The golf club comprising a club shaft according to claim 1 or 2, and a golf club head.

* * * * *